United States Patent [19]

Kanner

[11] Patent Number: 4,941,276

[45] Date of Patent: Jul. 17, 1990

[54] MARKETING DISPLAY DEVICE

[76] Inventor: Donald R. Kanner, 2324 N. Greenview St., Chicago, Ill. 60614

[21] Appl. No.: 325,856

[22] Filed: Mar. 20, 1989

[51] Int. Cl.[5] ..... G09F 1/08

[52] U.S. Cl. ..... 40/538

[58] Field of Search ..... 40/538, 124.4, 649, 40/642, 539, 312, 540, 1, 311, 299, 641, 587; 116/200; D6/305; 272/10

[56] References Cited

U.S. PATENT DOCUMENTS

| | | | |
|---|---|---|---|
| Re. 20,599 | 12/1937 | Shaw | 40/538 |
| 791,912 | 6/1905 | Jackson | 40/538 |
| 1,168,760 | 1/1916 | Sworzyn | 40/647 |
| 1,380,198 | 5/1921 | Farnham | 40/642 |
| 1,490,341 | 4/1924 | Olney | 40/311 |
| 2,979,841 | 4/1961 | Bellis | 40/538 |
| 3,570,728 | 3/1971 | DeWitt et al. | 40/538 |

FOREIGN PATENT DOCUMENTS

| | | | |
|---|---|---|---|
| 646653 | 11/1928 | France | 40/538 |

*Primary Examiner*—Kenneth J. Dorner
*Assistant Examiner*—J. Hakomaker

[57] ABSTRACT

A three-dimensional display device, preferably of molded plastic, having simulations of cold-cut slices of various common thicknesses, available for visual and tactile inspection, mounted edgewise on a point-of-purchase display board. Numerical quanta in direct proportion to slice thickness is printed adjacent each slice for allowing the purchaser to select slice thickness by number.

1 Claim, 1 Drawing Sheet

MARKETING DISPLAY DEVICE

FIELD

This invention relates to sales displays and more particularly to a novel sales display with simulations of thinly sliced meat, cheese and the like, commonly called cold-cuts.

BACKGROUND OF THE INVENTION

The purchasing public often has difficulty in ordering cold-cuts which are custom sliced to the purchaser's specifications. While the purchaser may ask for thin or medium slices by his definition, the seller may cut the slices as thin or medium by a different definition. Often the result is customer dissatisfaction or reslicing by the seller possibly resulting in product waste. While most professional slicing machines are capable of a variety of slicing thicknesses with a high reproducibility rate, directly proportional to a numerical scale, the purchaser is left without a clear link to the slicing machine's capabilities.

SUMMARY OF THE INVENTION

Accordingly, it is the object of this invention to provide a point-of-purchase sales display which gives the purchaser of custom sliced cold-cuts a numerical link to the capabilities of the cold-cut slicing machine. The invention allows the purchaser to examine three-dimensional, nonperishable, fabricated simulations or replicas of the product in advance of purchase without actual product handling. It further provides the purchaser with information that affords a greater degree of precision in the conveyance of his custom order to the seller. As an additional benefit, reduced product return resulting from purchaser dissatisfaction and reduced product spoilage resulting from reduced product handling will diminish waste and increase sales efficiency through use of the novel sales display. Yet a further benefit of the invention is that the visually handicapped are provided with sufficient knowledge to make more informed purchases of cold-cuts through tactile examination of cold-cut simulations and numerical quanta in either raised numbers or braille.

These objects are achieved by forming a panel having a series of cold-cut slice replicas having their edges projecting from the surface thereof. Each slice in the series is of increasing thickness and is identified by a numerical designation on the panel adjacent the slice. The numerical scale is proportional to the corresponding settings on the professional slicing machine.

Other objects, advantages and capabilities of this invention will become apparent from the following description when read in conjunction with the accompanying drawings.

THE DRAWINGS

DETAILED DESCRIPTION

Display panel 10 is made from plastic or heavy cardboard. Round meat or cheese slices 12*a*–12*e* are mounted in series on the surface of the panel 10 with their semi-circular edges projecting therefrom. Beneath each of the slices is a numerical index which corresponds to indicia on the slicing machine so that the thickness of the actual sliced meat or cold-cut corresponds precisely to the thickness of the replica 12*a*, 12*b*, etc. The panel 10 has a pair of triangular ribs 14 projecting from the rear face of panel 10 which support the panel in an upright position when placed on a counter top in a market.

Figure 1:
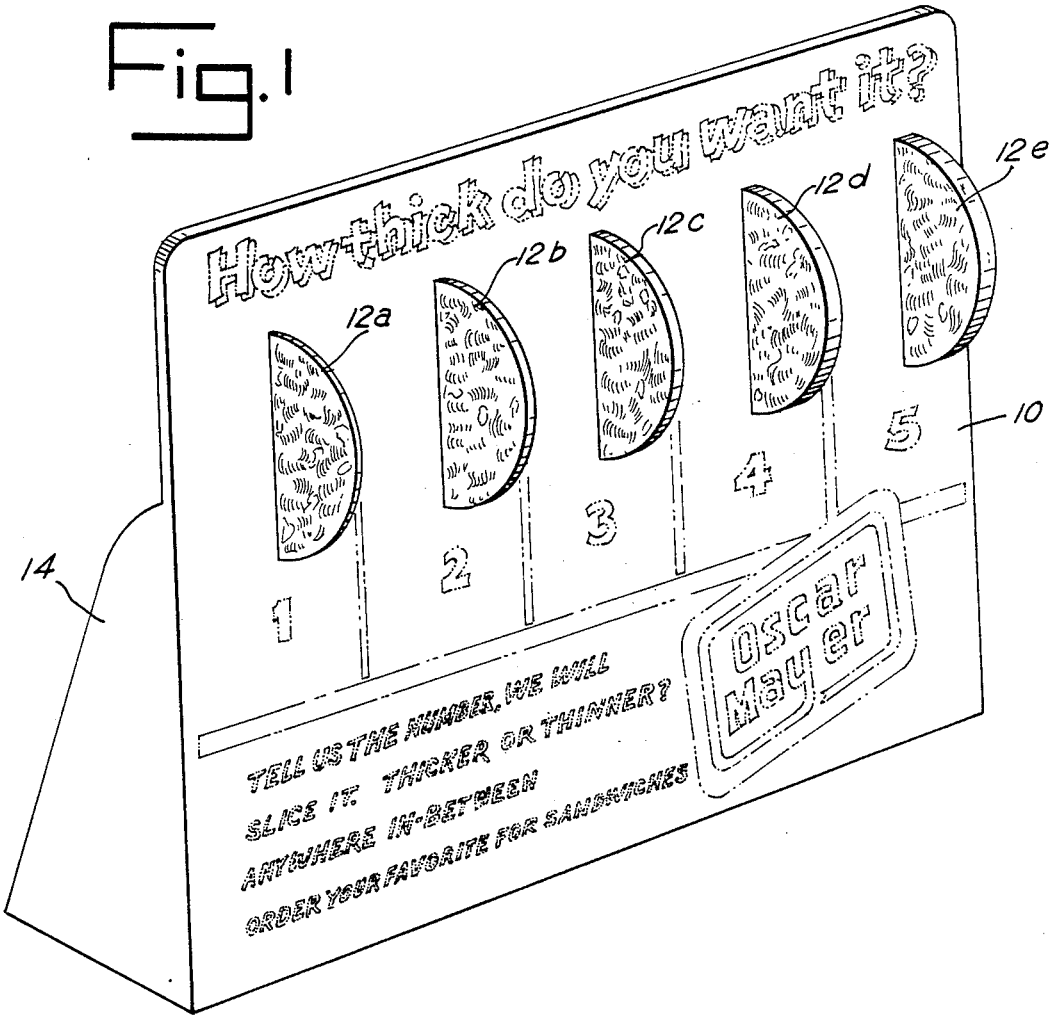
FIG. 1 is a perspective view of the point-of-purchase display panel showing five cold-cut slice thickness simulations related to numerical quanta.
Figure 2:
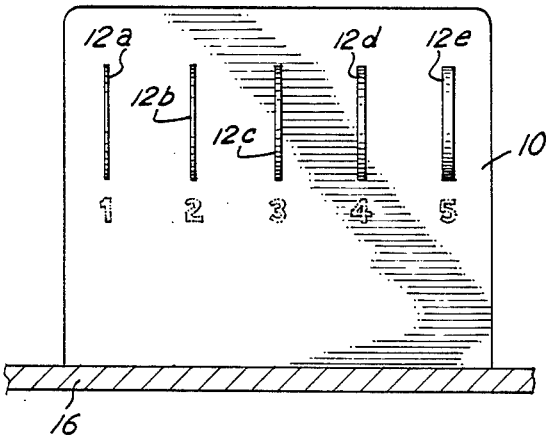
FIG. 2 is a front elevational view of the display panel of FIG. 1.
Figure 3:
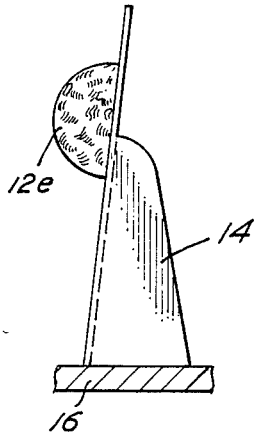
FIG. 3 is a side elevational view of the display panel of FIG. 1.
Figure 4:
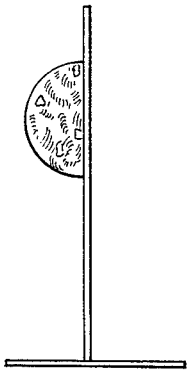
FIG. 4 is a side elevational view of a modified support for the display panel.

In FIGS. 2–4 the display panel is shown on a support surface 16 such as a counter top.

The numerical indicia printed on the panel adjacent the slices may be raised so that visually handicapped persons can select the desired product thickness by feeling the replica slice and the adjacent numeral, which may be raised.

Instructional information and advertising copy, trademarks or the like can be printed on the surface of panel 10. The printing can be duplicated in braille. The display device preferably is molded from plastic material to provide a unitary structure which will withstand handling or dropping on the floor without breaking. Molded plastic also facilitates forming the raised indicia. The slices may be decorated to duplicate the color and texture of the meat, cheese, sausage or other cold-cut which is replicated on the display.

The present invention may be provided as part of a complete kit which includes the display board, support stand, and complete instructions intended to maximize the invention's effectiveness to seller and purchaser.

Although the present invention has been described with a certain degree of particularity, it is understood that the present disclosure has been made by way of example and that changes in details of structure may be made without departing from the spirit thereof.

What is claimed is:

1. A three dimensional display device for facilitating the selection of sliced food according to its thickness comprising;

a display panel having a front face and a rear face, a series of semi-circularly shaped discs projecting outwardly from the front face of the display panel, each said disc in the series of discs being of progressively increasing thickness, and tactually discernible indicia printed on the front face of the display panel adjacent each said disc designating numerically the relative thickness thereof, whereby the purchace of sliced food can be easily determined beforehand by visual and tactile examination of the display.

* * * * *